US010967244B2

(12) United States Patent
Lininger, Jr.

(10) Patent No.: US 10,967,244 B2
(45) Date of Patent: Apr. 6, 2021

(54) SURFSKATE SKATEBOARD TRUCKS

(71) Applicant: Robert Lininger, Jr., Redondo Beach, CA (US)

(72) Inventor: Robert Lininger, Jr., Redondo Beach, CA (US)

( * ) Notice: Subject to any disclaimer, the term of this patent is extended or adjusted under 35 U.S.C. 154(b) by 0 days.

(21) Appl. No.: 15/881,750

(22) Filed: Jan. 27, 2018

(65) Prior Publication Data

US 2019/0232152 A1 Aug. 1, 2019

(51) Int. Cl.
*A63C 17/01* (2006.01)
*A63C 17/00* (2006.01)

(52) U.S. Cl.
CPC ..... *A63C 17/012* (2013.01); *A63C 17/0046* (2013.01)

(58) Field of Classification Search
CPC ..... A63C 17/01; A63C 17/012; A63C 17/015; A63C 17/0093; A63C 17/02; A63C 17/0046
See application file for complete search history.

(56) References Cited

U.S. PATENT DOCUMENTS 326,539 A 9/1885 Baker
921,102 A * 5/1909 Grout ..... A63C 17/02 280/11.28
2,275,035 A * 3/1942 Pardon ..... A63C 17/02 280/11.28
3,774,924 A * 11/1973 Machatsch ..... A63C 17/0046 280/11.28
4,109,925 A * 8/1978 Williams ..... A63C 17/01 280/11.28
4,152,001 A * 5/1979 Christianson ..... A63C 17/01 280/11.28
4,230,330 A * 10/1980 Muhammad ..... A63C 17/01 280/87.042
4,245,848 A * 1/1981 Dudouyt ..... A63C 17/01 280/11.28
4,251,087 A * 2/1981 Hansen ..... A63C 17/01 280/11.28
4,398,735 A * 8/1983 Evans ..... A63C 17/01 280/11.28
4,402,521 A * 9/1983 Mongeon ..... A63C 17/02 280/11.225
6,318,739 B1 * 11/2001 Fehn, Jr. ..... A63C 17/0046 280/11.223
6,793,224 B2 9/2004 Stratton
6,979,007 B1 12/2005 Hosoda
6,981,710 B2 1/2006 Cheng
(Continued)

*Primary Examiner* — Emma K Frick
(74) *Attorney, Agent, or Firm* — Alexander R. Schlee; Schlee IP International, PC

(57) ABSTRACT

A skateboard truck configured to be mounted to a skateboard deck, with a hanger with a wheel axle configured to hold skateboard truck wheels; a suspension system with a flex member configured to attach the hanger resiliently to a skateboard deck; a rolling contact bearing connecting the hanger with the flex member such that the rolling contact bearing allows rotation of the hanger with respect to the flex member by a steering angle around a steering axis extending substantially vertically to the wheel axle; and a spring mechanism attached to or integrally formed with the flex member biasing the hanger to the neutral position where the steering angle is zero.

18 Claims, 9 Drawing Sheets

(56) References Cited

U.S. PATENT DOCUMENTS

| | | | | |
|---|---|---|---|---|
| 7,287,762 | B2 | 10/2007 | Stratton | |
| 7,341,260 | B1 | 3/2008 | Hosoda et al. | |
| 8,246,058 | B2 | 8/2012 | Wang et al. | |
| 8,602,422 | B2 * | 12/2013 | Wilson | A63C 17/006 280/11.27 |
| 9,295,902 | B2 * | 3/2016 | Lininger, Jr. | A63C 17/0033 |
| 9,415,295 | B2 | 8/2016 | Braden et al. | |
| 9,821,215 | B2 * | 11/2017 | Ivazes | A63C 17/0046 |
| 10,376,773 | B2 * | 8/2019 | Chung | A63C 17/01 |
| 2006/0096239 | A1 * | 5/2006 | Lin | A63C 17/01 52/750 |
| 2008/0252026 | A1 * | 10/2008 | Kang | A63C 17/0093 280/11.27 |
| 2013/0069331 | A1 | 3/2013 | Yamada | |
| 2015/0097352 | A1 * | 4/2015 | Ivazes | A63C 17/012 280/124.175 |

* cited by examiner

SURFSKATE SKATEBOARD TRUCKS

BACKGROUND OF THE INVENTION

Previous attempts to provide adjustment to restrictive force of the truck pivoting have been non-existent or require a mechanical tool and a formula is needed to determine how many turns the adjuster screw must be turned and in which direction to increase the resistive force in the resting position to create stability enough for cruising and higher speeds.

Cheng U.S. Pat. No. 6,981,710 discloses a biasing mean to apply resistive force to hanger, but is limited because the bias arms are operable in only one direction, thereby requiring two spring arms, one to resist leftward rotation of the hanger and one to resist rightward rotation of the hanger. It is limited also because the rider would need to carry tools with them to change the resistance if different terrains were encountered or different riding styles were desired.

Providing the appropriate characteristics of a spring force forcing the hanger of a skateboard truck, meaning the wheel axle into the neutral position is particularly crucial for so-called surfskate trucks that allow a significant steering angle.

It is therefore desirable to provide a functionality that allows the rider to quickly change the characteristics of the truck for more stability for higher speed transportation purposes or less stability for slow speed play. Turning dynamics should preferably be selectively changed by the rider in predetermined increments without requiring tools as in the past thereby conveniently and quickly increase or decrease stability based on riding style desired.

SUMMARY OF THE INVENTION

It is an object of the invention to provide designs that accomplish a wide steering angle for surfskate functionality allowing very tight turns on a skateboard.

It is another object to allow adjustability of a spring rate urging the skateboard truck into the neutral position where the wheel axle is perpendicular to a longitudinal axis of the skateboard.

It is yet another object to accomplish engaging or disengaging different spring mechanisms, and in addition adjusting these for higher or lower spring rates.

According to a further embodiment, also a suspension system allowing some general movement of the wheel axle closer to the underside of the skateboard deck or away from it for providing some cushion dampening the effects of a rough street surface or running over obstacles.

This and other objects are accomplished by a skateboard truck configured to be mounted to a skateboard deck, comprising: a hanger with a wheel axle configured to hold skateboard truck wheels; a suspension system comprising a flex member configured to attach the hanger resiliently to a skateboard deck; a rolling contact bearing connecting the hanger with the flex member such that the rolling contact bearing allows rotation of the hanger with respect to the flex member by a steering angle around a steering axis extending substantially vertically to the wheel axle; and a spring mechanism attached to or integrally formed with the flex member biasing the hanger to the neutral position where the steering angle is zero.

DETAILED DESCRIPTION OF THE INVENTION

The invention encompasses essentially to embodiments, namely a first with biasing means is of the same member as the base and a pivot cup bearing is a connector to the biasing means, allows a union of two biasing means on a single protrusion, wherein a movable restrictor can increase the resistance of the biasing means. According to a second embodiment, another unique resistance adjustment is provided where an adjuster changes an engagement point closer or further away from the torsional spring to increase resistance without tools. Further, selectable engagement of biasing means with hanger protrusions and a biased angle adjustment stops are provided giving a pop back.

In a preferred embodiment of the invention, construction is disclosed that allows the rider to quickly change the characteristics of the truck for more stability for higher speed transportation purposes or less stability for slow speed play. Turning dynamics can be selectively changed by the rider in predetermined increments without requiring tools as in the past thereby conveniently and quickly increase or decrease stability based on the riding style desired.

In a preferred embodiment of the invention it is disclosed showing a feature that allows the user to quickly make the skateboard more stable by increasing the amount of resistive force required for turning.

In a preferred embodiment a restrictor guide that nests into predetermined detents along the adjoining flex member surface to influences the flex member void length having an effect of shortening the void, resistance can be increased.

In another preferred embodiment of the invention it is disclosed showing a feature that allows the user to quickly make the skateboard more stable by increasing the amount of resistive force required for turning.

Yet another preferred embodiment of the invention is constructed with at least one hanger protrusion assembly. The hanger protrusion assembly consists of a protrusion housing, an actuator, a coil spring and a hanger protrusion having a first position and a second position. When in the first position, the hanger protrusion is retracted and is disengaged from a receiver defined by a void in the flex member. When in the second position, the hanger plunger is engaged into a receiver in the flex member and provides a predetermined resistance to the rotation of the hanger on the pivot axis In a preferred embodiment of the invention, a torsional spring is disclosed as the primary rotational resistive element with the plunger and flex base receiver biasing means shown as a supplemental means of changing the performance of the truck. The torsion spring having a unique threaded rod adjuster providing a variable contact point with the torsional spring.

A unique receiver bearing cup according to a preferred embodiment allows multiple receivers to be engaged by a single rotating protrusion intersecting the hangers rotating trajectory. The receiver bearing cup is fitted with an elastomer bushing to dampen vibration and allows the receiver to stay in alignment with the protrusion through the rotation cycle.

Receiver stops defined by voids are placed along the trajectory of the rotating hanger assembly limiting the angle of rotation and urging the hanger to return to the resting position.

It is to be noted that the flex member is designed to elastically deform to store energy providing resistance as forces acting on the mechanism are applied moving downward and upward as outside forces are applied until the flex member abuts into the bumper providing suspension and a smoother ride to the user.

Likewise, a receiver defined by a void in the flex member when engaged by a hanger protrusion extending from the hanger elastically deforms the flex member and stores energy when the hanger moves leftward or rightward from the resting position and use this energy as a resistive force to return the hanger to the resting position. If the void length, relative to the receiver, is lengthened, more movement is possible however, the resistive force will be less. If the void, in relationship to the receiver, is shortened, less movement is possible however, the resistive force will be greater.

At least one receiver may be provided, defined by a void in the flex member along the intersection of the hanger rotation trajectory. The voids allow the receiver to move a specified amount within the yield limits of the material and desired resistance specifications.

A means is also disclosed to close off portions of the voids with an elastic movable restrictor to increase resistance when desired in predetermined increments without needing tools.

Voids in the flex members can be configured in various profiles and volumes to achieve the amount of energy storage and resistance desired According to a preferred embodiment, a base member is constructed having repulsive force to return the hanger to a resting position.

According to a preferred embodiment, a hanger coupler member extending from the base plate and comprising of a first surface and a second surface wherein the first surface is configured to face the baseplate and at least one hanger protrusion extending outwardly is provided.

According to a preferred embodiment, the surf skate is configured to engage at least one protrusion extending outwardly from the hanger connector wherein a base flex member attachable to the underside of a skateboard deck having at least one receiver defined by a void in the flex member intersecting the rotation trajectory of the hanger, and a hanger is pivotally attached in an inclined manner to the base flex member having at least one hanger protrusion that is configured to engage said receiver defined by a void in base flex member at least temporarily restricting rotation of the hanger on said pivot axis leftward and rightward away from the resting position. A coupling can be operatively connected to the base and the hanger and an axle affixed to hanger configured to receive wheel assemblies.

DETAILED DESCRIPTION OF THE DRAWINGS

Figure 1:
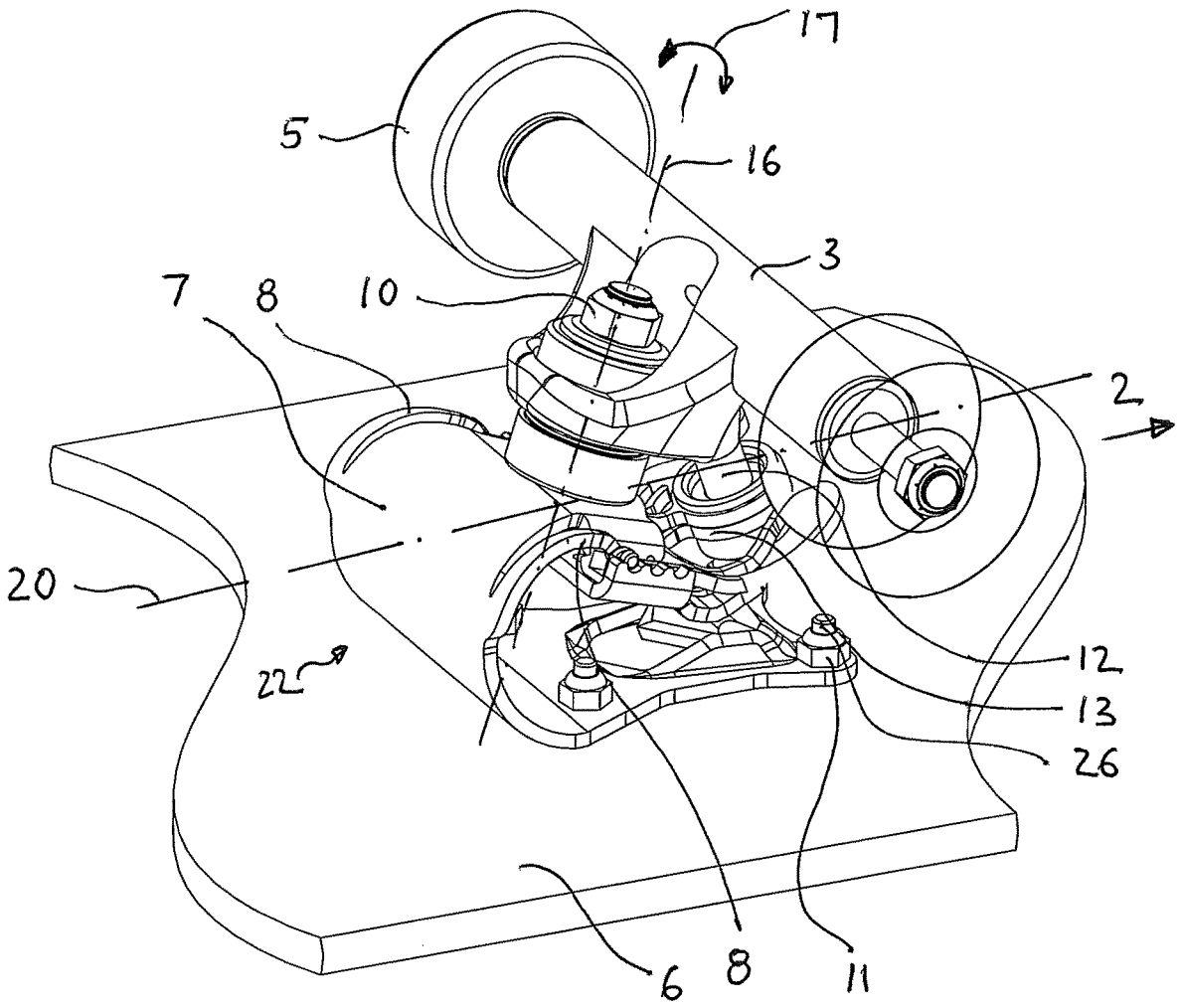
FIG. 1 shows a perspective view of a first embodiment of the invention.
Figure 2:
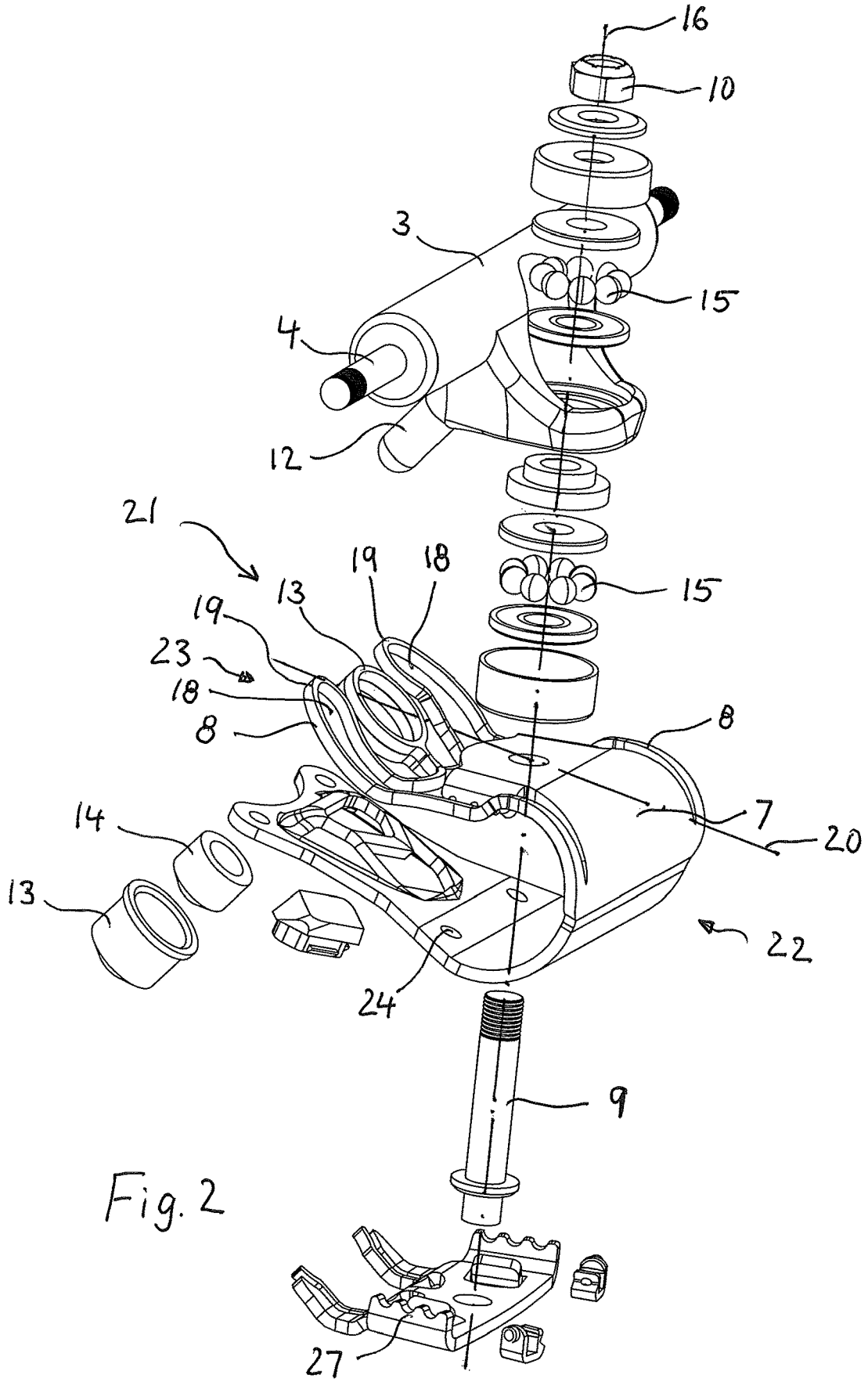
FIG. 2 shows an exploded perspective view of the first embodiment of the invention

FIG. 1 shows a skateboard truck according to a first embodiment as installed at the front of a skateboard in skating direction demonstrated by arrow 2. The skateboard truck comprises a hanger 3 having a wheel axle 4 (See FIG. 2) carrying wheels 5. The hanger assembly is attached to a skateboard deck 6 by a flex member 7 comprising flexible arms 8 by a kingpin 9. The flex member may be attached to the skateboard deck 6 directly by attachment nuts 11 or optionally through some other element such as wedges or other forms of an additional base. A protruding element 12 is integrally formed with the hanger 3 and inserted into a pivot cup 13 via a cup-shaped resilient member 14. Rolling contact bearings 15, here in the form of ball bearings 15 while in the alternative also other types of bearings such as roller bearings may be used, allow rotation of the hanger 3 around the kingpin 9 functioning as a steering axle with the center axis of the kingpin 9 forming the steering axis 16 around which the hanger can swivel by a steering angle demonstrated by arrows 17. In the first embodiment shown in FIGS. 1 and 2, the flexible arms 8 are formed as loops 18 having a turning point 19 at which the arms loop back from a position further apart from a longitudinal center axis 20.

The flex member 7 is generally U-shaped and comprises a rear portion 22 as well as a front portion 23. The flexible arms 8 are formed by voids that may, for instance, be formed by a punching process of punching out parts of metal sheet or metal plate and the flex member 7 can be manufactured by bending it into a U-shape. In addition, mounting holes 24 can be provided for mounting the flex member to the skateboard deck 6 by screws 26 penetrating through the mounting holes 24 and the attachment nuts 11 screwed onto the screws 26.

Figure 3:
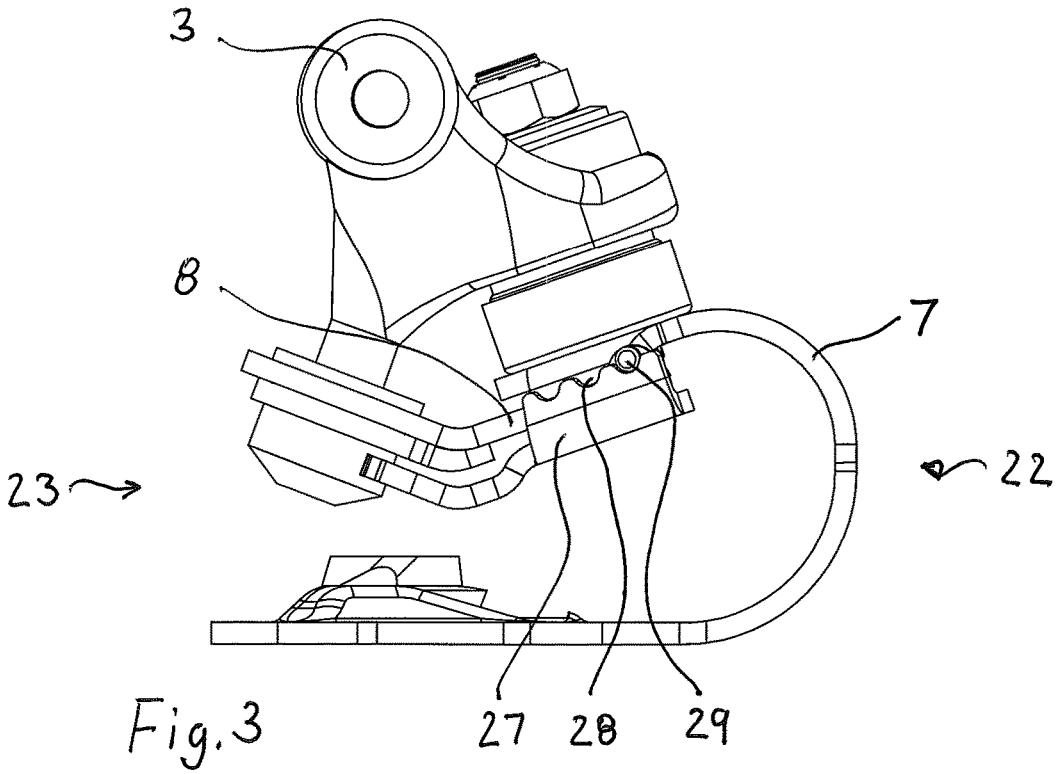
FIG. 3 shows a side view of the first embodiment of the invention.
Figure 4:
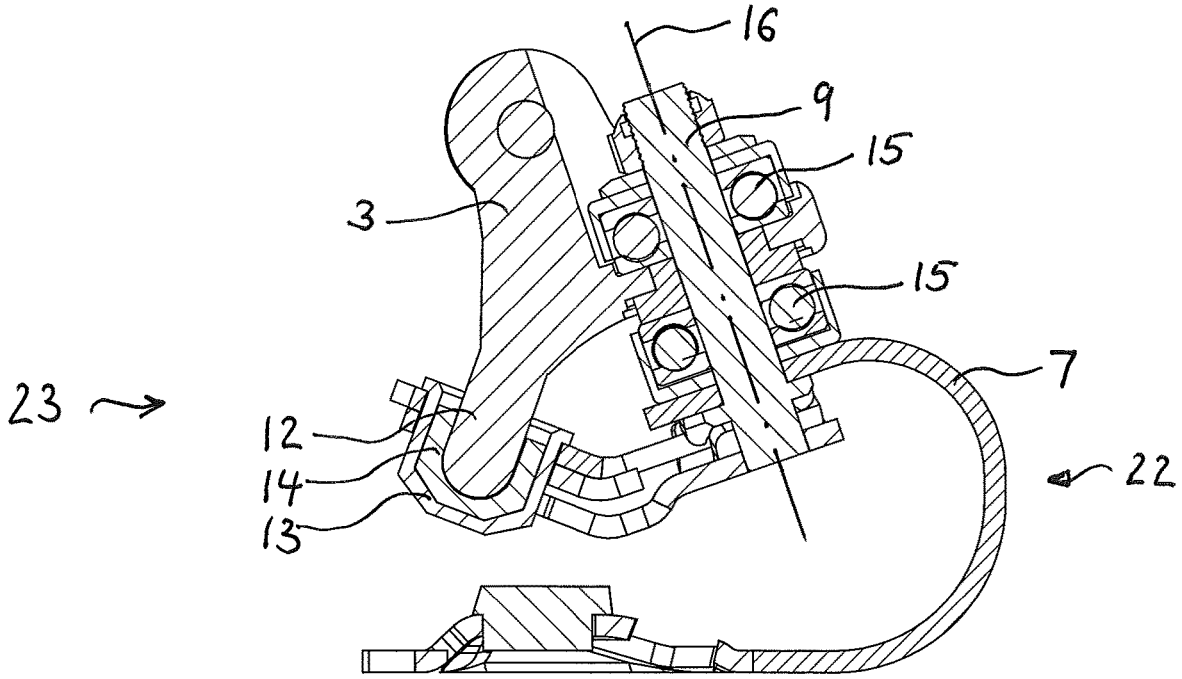
FIG. 4 shows a side view of the first embodiment of the invention, partially as a sectional view.
Figure 5:
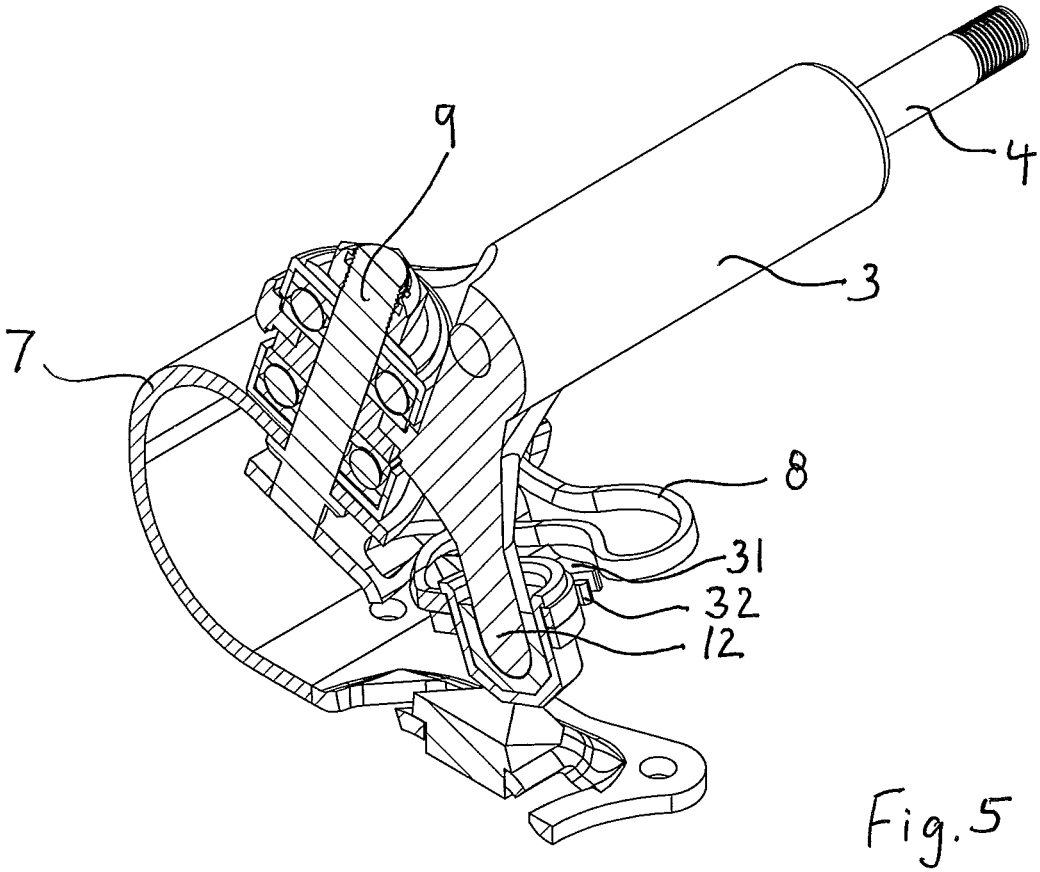
FIG. 5 shows essentially the same view as FIG. 4, but as a perspective view.

FIG. 3 shows a side view of the skateboard truck, while FIG. 4 shows the same side view, but partially as a sectional view. The steering axle 16 is also demonstrated in this side view according to FIG. 4. As shown in FIG. 3, a restrictor is provided and can be moved towards the front portion 23 or vice versa towards the rear portion 22 of the flex member 7. In FIG. 3, the restrictor 27 is shown in its front most position where it limits the flexible length of the arms 8 the most and therefore creates the highest spring rate, meaning also the highest resistance against the pivot cup 13 moving away from its neutral position at the steering angle zero to a position offset from the longitudinal center line 20. Moving the restrictor towards the rear portion 22 of the flex member 7 increases the flexible length of the flexible arms 8, and therefore lowers the spring rate and consequently the resistive force against moving the pivot cup 13 away from its neutral position where it is aligned on the longitudinal center axis 20. The restrictor 27 can be provided with a latching mechanism, for instance notches 28 that may be engaged by a pin 29, holding the restrictor and 27 in place in comparison to the flex member 7 with its flexible arms 8.

Figure 6:
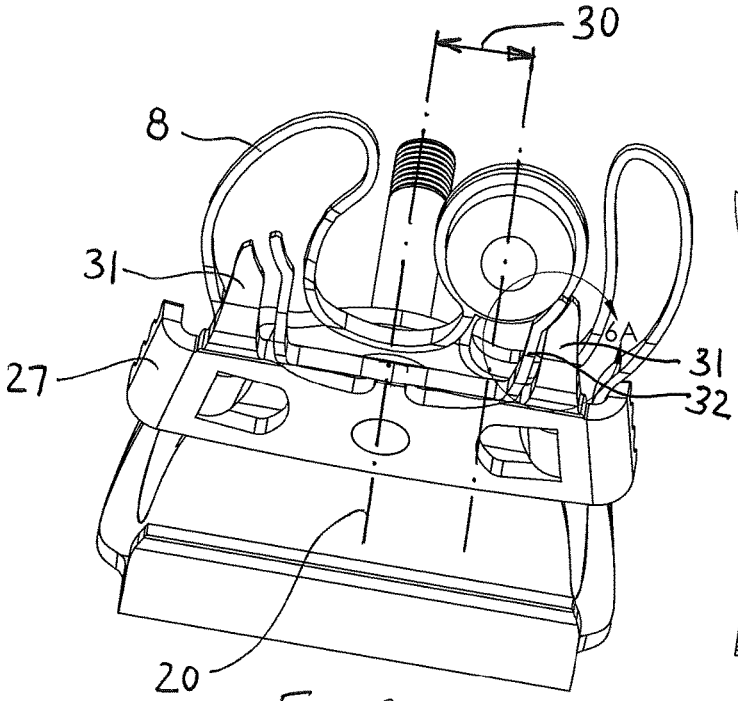
FIG. 6 shows a perspective view of a partial assembly of the first embodiment of the invention essentially as a bottom view.
Figure 7:
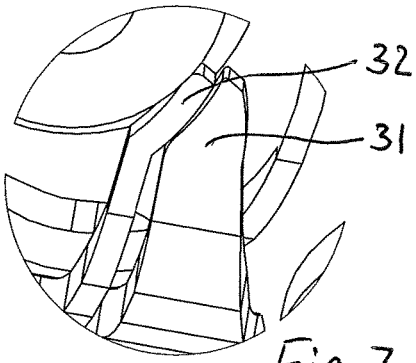
FIG. 7 shows a detailed perspective view denoted 6A in FIG. 6.
Figure 8:
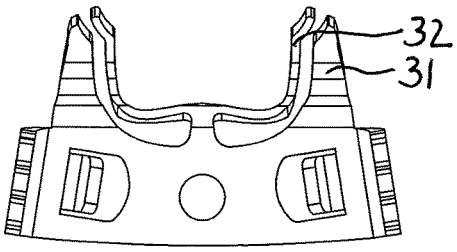
FIG. 8 shows a detail plan view of a restrictor as part the first embodiment of the invention.
Figure 9:
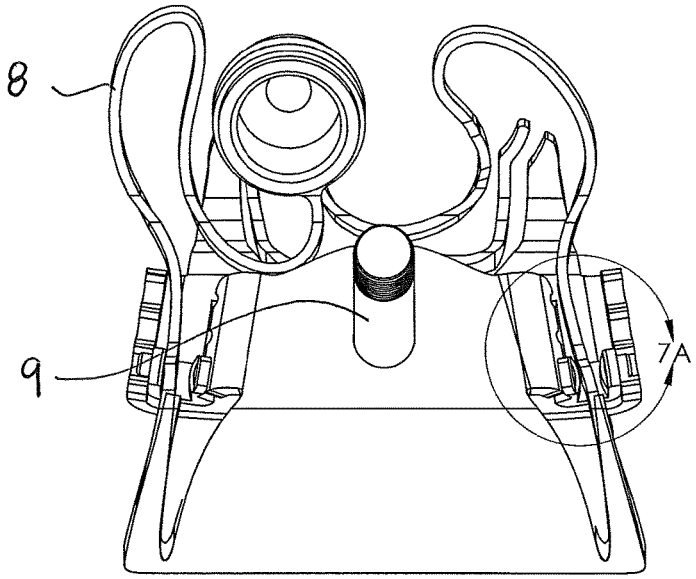
FIG. 9 shows a perspective view of a partial assembly of the first embodiment of the invention essentially as a top view.

FIG. 6 shows a perspective view of a partial assembly essentially from the bottom demonstrating the maximum moving distance 30 of the pivot cup 13 from the longitudinal centerline 20 where further movement away from the longitudinal centerline is stopped by the stop 31. This position, as shown in FIG. 6, also marks the maximum steering angle. As it becomes clear from FIG. 2 and FIG. 4, the maximum rotation around the steering axis 16 is determined as to how far the pivot cup 13 can be moved from its neutral position where it is aligned with the longitudinal center axis 20 to the side since this movement to the side determines how far the hanger 3 can rotate around the steering axis 16. As also best seen in FIG. 6, the flexible arms 8 are resiliently deformed for a establishing a maximum moving distance of the pivot cup 13. Prior to be finally stopped by the stopped 31, a spring arm 32 is deformed up to the point where it abuts against the stop 31. FIG. 7 shows a detailed view marked 6A in FIG. 6 while FIG. 9 shows the restrictor 27 that also accommodates the spring arm 32. This accomplishes a so-called soft stop, namely the resulting spring rate determined by the formation of the flexible arms 8 is increased by the additional deformation of the spring arm 32 while finally a relatively hard stop is provided when the spring arm 32 is deformed to the extent that it abuts against the stop 32. Some very minor additional resilience might be provided by the possibility of some additional deformation of the resilient member 14 with in the pivot cup 13, and of course by a possible very limited deformation of the hard stop 31. The spring arm 31 also provides the function of a pop back, namely a increased spring rate over a short range close to hitting the final stop. This pop back is typically perceived as positive by skateboard riders, helping to push back quicker in direction of the neutral position when the outer limit is reached.

Figure 10:
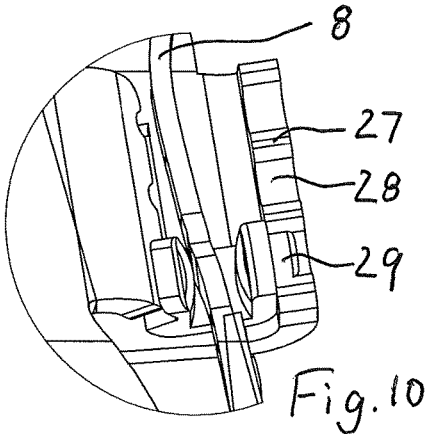
FIG. 10 shows a detailed perspective view denoted 7A in FIG. 9.
Figure 11:
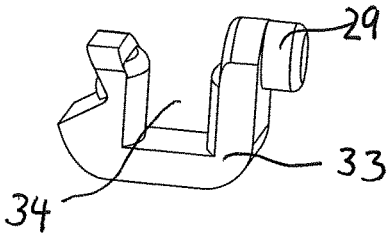
FIG. 11 shows a detail perspective view of a restrictor element as part of the first embodiment of the invention.

FIG. 9 shows a similar view than FIG. 6, but essentially from the top. The detail denoted 7A shown in FIG. 10 demonstrates the restrictor 27, and specifically the pin 29 engaging the notches 28 by lifting the pin 29 is integrally formed with a generally U-shaped movable restrictor element 33 that can be moved along the restrictor and 27 by lifting it up and moving it one notch 28 further, for instance towards the front, consequently either shortening or lengthening the flexible length of the flexible arms 8 held between an open space 34 in the restrictor element 33. FIG. 11 shows a detailed perspective view just of the restrictor element 33.

Figure 12:
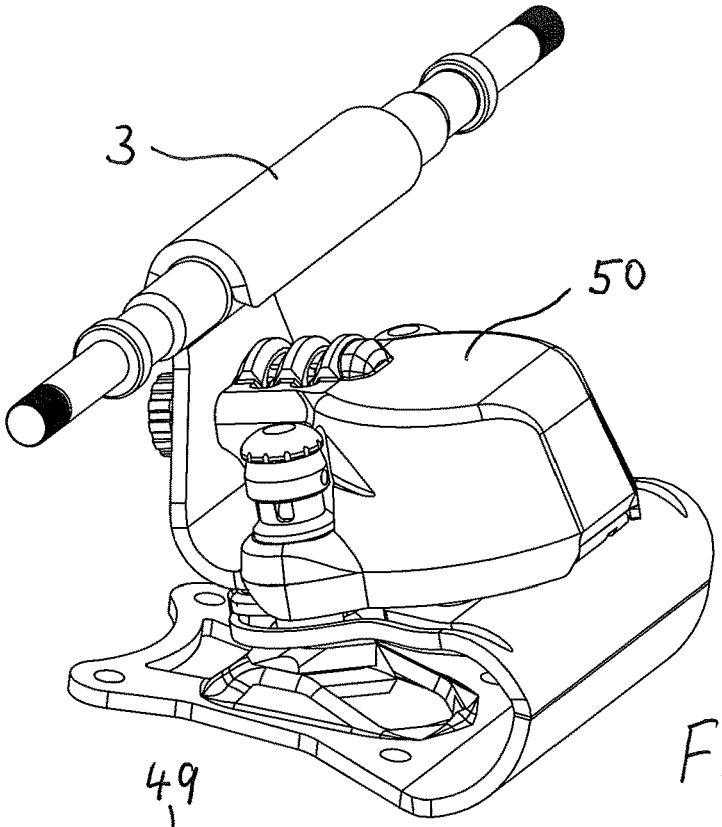
FIG. 12 shows a perspective view of a second embodiment of the invention.
Figure 16:
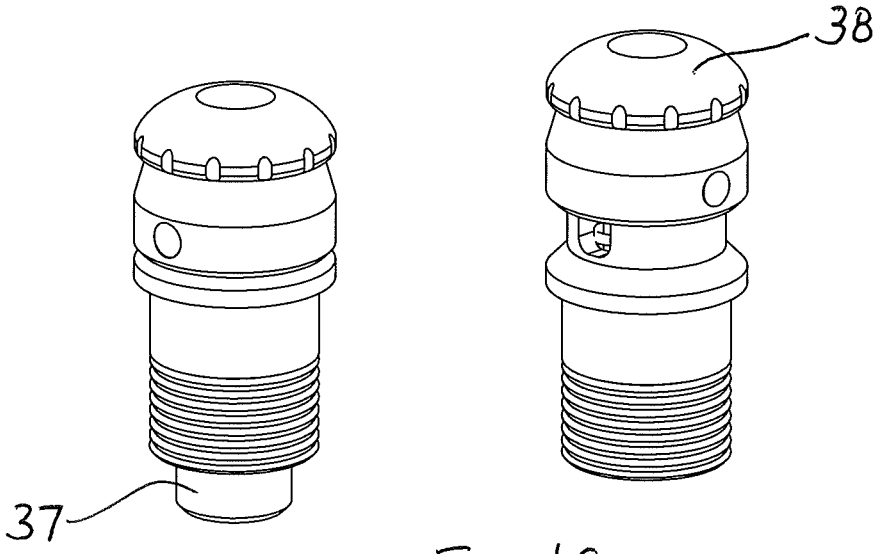
FIG. 16 shows a perspective view of the latching mechanism used in the second embodiment of the invention in latched and unlatched positions.

FIG. 12 shows a perspective view of a second embodiment of the skateboard truck according to the invention. Similar elements with the same functional significance as denoted in the first embodiment are denoted by the same reference numerals in the second embodiment. This second embodiment provides additional functionality in that the spring rate for the steering movement of the hanger 3 can be even more fine tuned and manipulated in a wider range. For instance in the configuration shown in FIG. 13, the spring arms 8 are not engaged by the released position of a latching element 35, here formed as an eye at the free end of the flexible arm 8 that is engageable by a latching mechanism 36. This latching mechanism 36 comprises a shaft 37 screwed into a 38 and biased into the latching position by a latching spring 39. When the latching element 35 is engaged by the shaft 37, this connects the hanger 3 with the latching element 35 and therefore with the flexible arms 38, so that a relative rotation between the hanger 3 and the flex member 7 resiliently deforms the flexible arms 8 so that the flexible arms 8 provide a spring force resisting such relative movement between the hangover 3 or any parts attached thereto with respect to the flex member 7. Consequently, the flexible arms 8 have the tendency to keep the hanger 3 in its neutral steering wheel position. Unlatching, meaning disengaging the shaft 36 from the latching alum and 35 can be accomplished by pulling up the 38 and rotating so that it snaps into a pulled up position by pins 14 latching into shallow notches 41. Rotating allows the pins 42 to latch into a deep notch and therefore allow the shaft 37 to be pushed down by the latching spring 39 into engagement with the latching element 35. The different cap positions are shown in FIG. 16, with the right side example showing the cap pulled up, while the left side drawing shows the 38 pushed down and with it the shaft 37, meaning the left side drawing shows the latched position.

Figure 17:
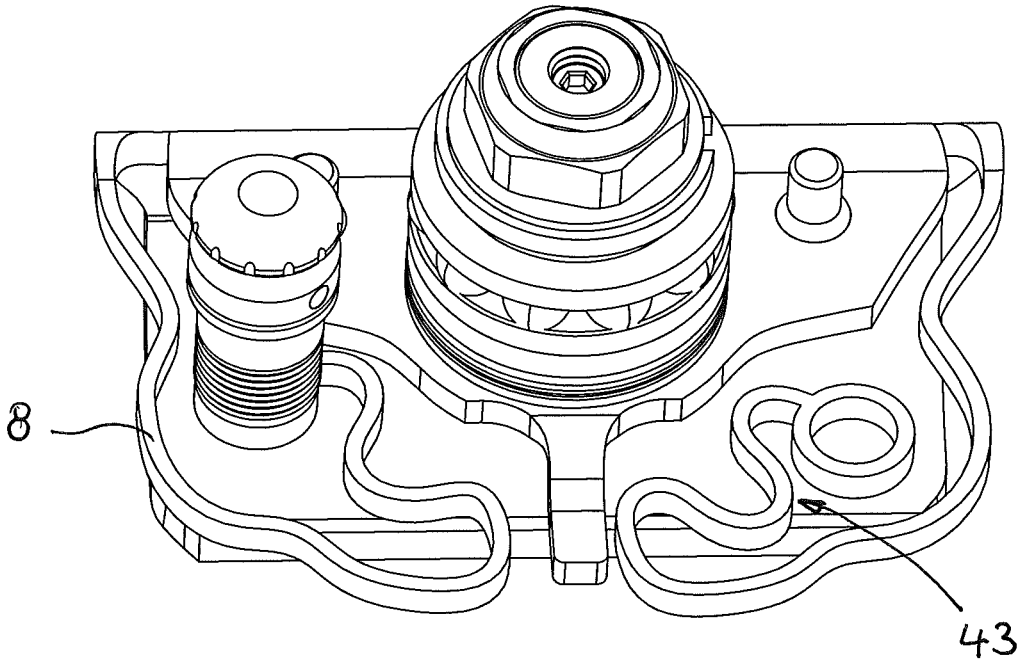
FIG. 17 shows a perspective plan view of a sub assembly demonstrating defamation of flexible arms in the second embodiment of the invention.

Apart from the meander shape 43 allowing an advantageous deformation pattern as for instance demonstrated in FIG. 17, demonstrating on the left side the latched position where the flexible arm 8 is deformed upon a relative rotational movement between the hanger 3 and the flex member 7, while the right side shows the un-latched position demonstrating the position of the flexible arm 8 assumes if not deflected.

Figure 15:
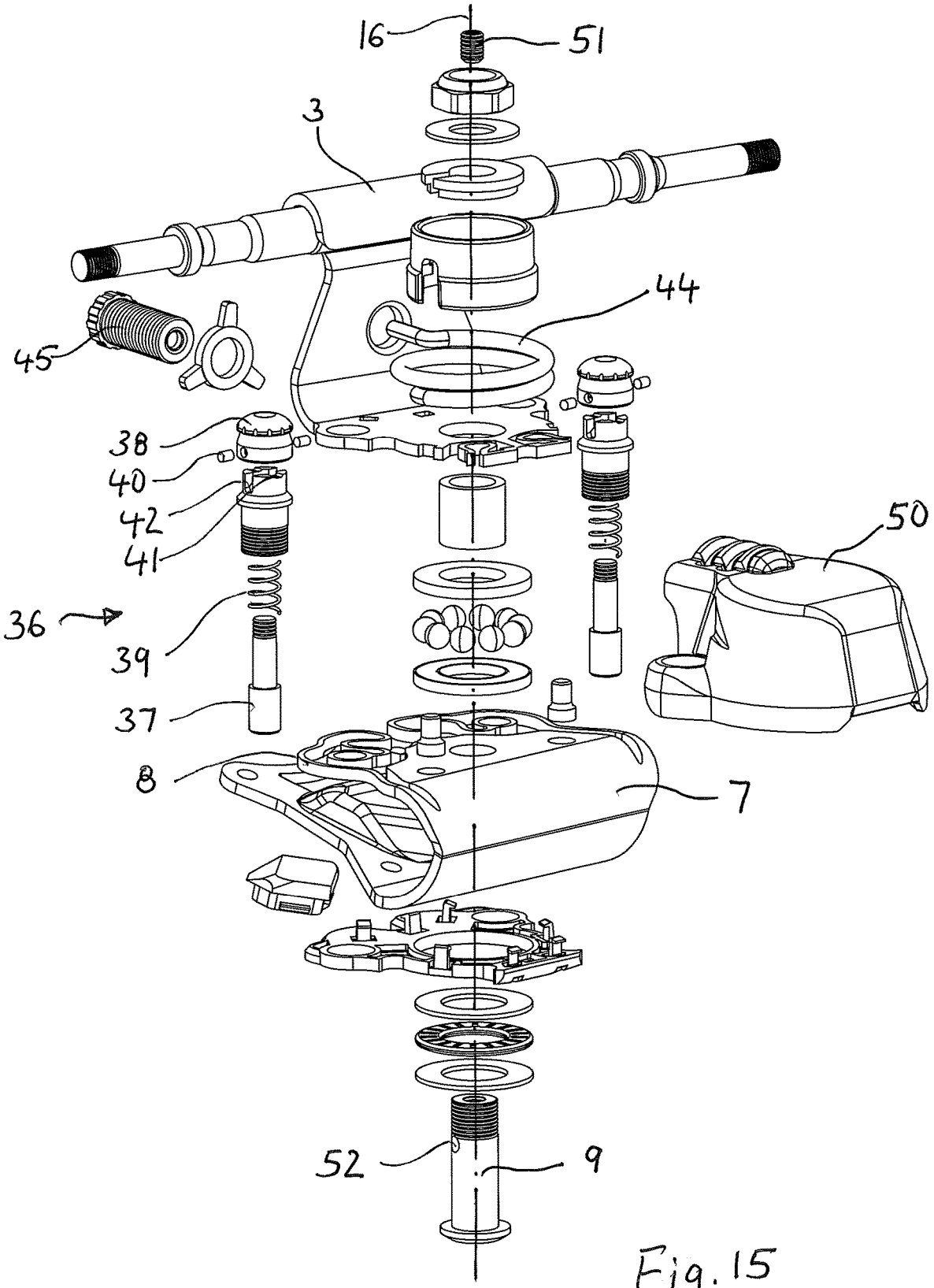
FIG. 15 shows an exploded perspective view of the second embodiment of the invention.
Figure 18:
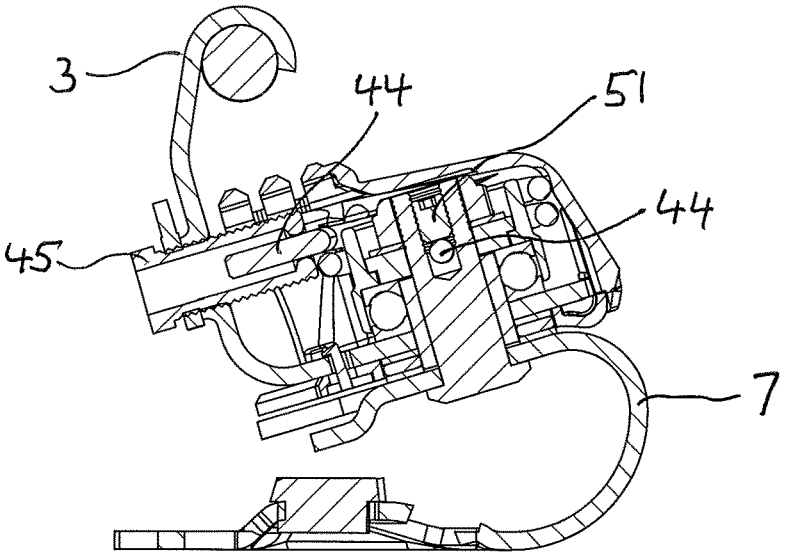
FIGS. 18-20 shows side views of the second embodiment of the invention, partially as a sectional view, demonstrating different torsional spring adjustment modes.

As shown in the exploded view according to FIG. 15, another spring mechanism in form of the torsional spring 44 is provided in the second embodiment. Also this torsional spring can be either fully engaged or disengaged, but in addition also the spring rate can be adjusted. The torsional spring 44 is in its engaged position at its one free end attached to the hanger 3 by an adjustment screw 45, and at its other free end engages the flex member or any elements that are attached thereto. In this second embodiment, the second free and of the torsional spring specifically engages the kingpin 9 through a through hole 52 through the kingpin 9, while the kingpin as described above is connected to the flex member 7. A worm screw 51, for instance designed as an Allen screw, is screwed into an internal thread, locking the second free end of the torsional spring into place within the kingpin 9 and consequently in relation to the flex member 7. This mechanism locking the second free and of the torsional spring 44 to the kingpin 9 is also shown in the sectional side views according to FIGS. 18-20.

Figure 19:
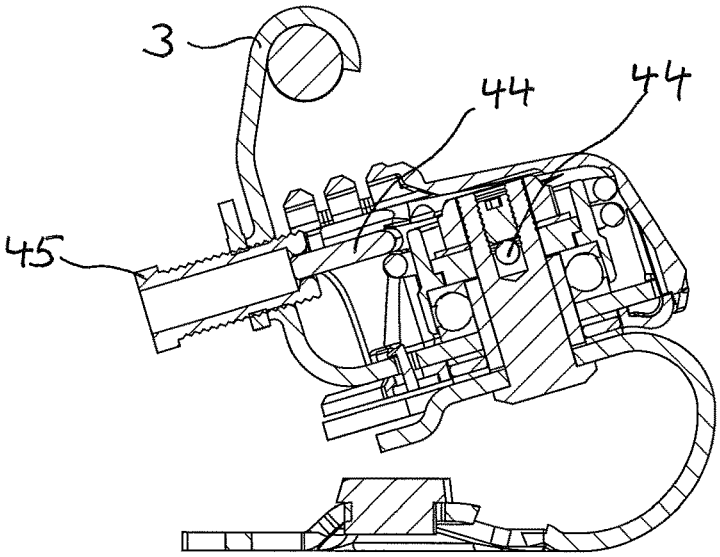
Figure 20:
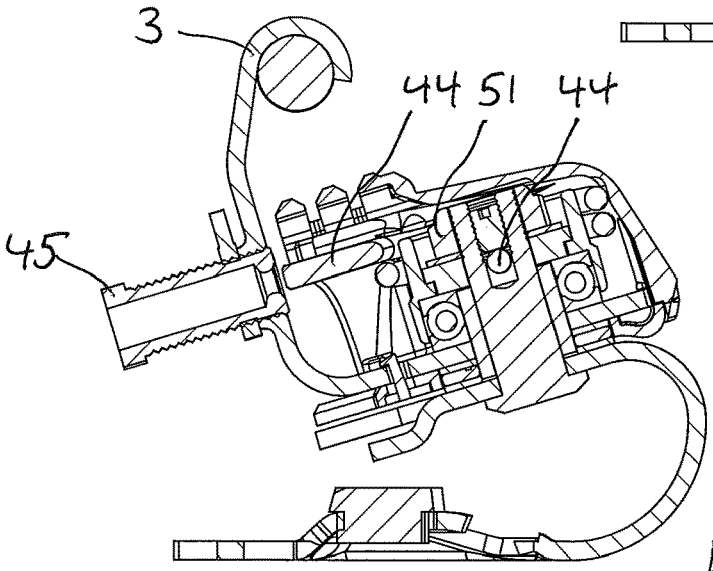

Consequently, a steering angle movement, meaning a rotation between the hanger 3 and the flex member 7, deforms the torsional spring 44 and therefore creates a torque around the steering axis 16. The adjustment mechanism including the adjustment screw 45 is demonstrated in FIGS. 18-20. While in the position shown in FIG. 18 the adjustment screw is screwed in, shortening the flexible length of the torsional spring 44, and therefore establishes a position for a high spring rate, meaning a high steering angle resistance. FIG. 19 accomplishes the opposite, namely lengthens the flexible length of the torsional spring 44 by screwing the adjustment screwed 45 to the outside. FIG. 20 shows the disengaged position, namely by screwing the adjustment screw 44 out of engagement with the torsional spring 44. Since in this position shown in FIG. 20 the torsional spring 44 is completely disengaged from the hanger 3, a relative rotational steering angle movement between the hanger 3 and the flex member 7 does not potential in the torsional spring 44 and therefore no spring force from the torsional spring 44 pushes the hanger 3 into the neutral position.

This second embodiment shown in FIGS. 12-20 therefore allows more options for establishing different spring rates, namely by either engaging or disengaging the flexible arms 8 and consequently using or not using the spring force of the flexible arms 8 to resist a steering angle movement, and/or engaging or disengaging the torsional spring 44 with the same effects of either applying or not applying a resistive force against a steering angle at all. In addition, the spring rate of the torsional spring 44 can be adjusted from stronger to weaker and vice versa. Since the "surf skate" function of the skateboard truck according to the incident invention is significantly influenced by different spring rates resisting a steering wheel movement, the second embodiment provides even more options, namely from no spring force at all to a maximum spring force where all spring mechanisms are engaged and set too high.

Figure 13:
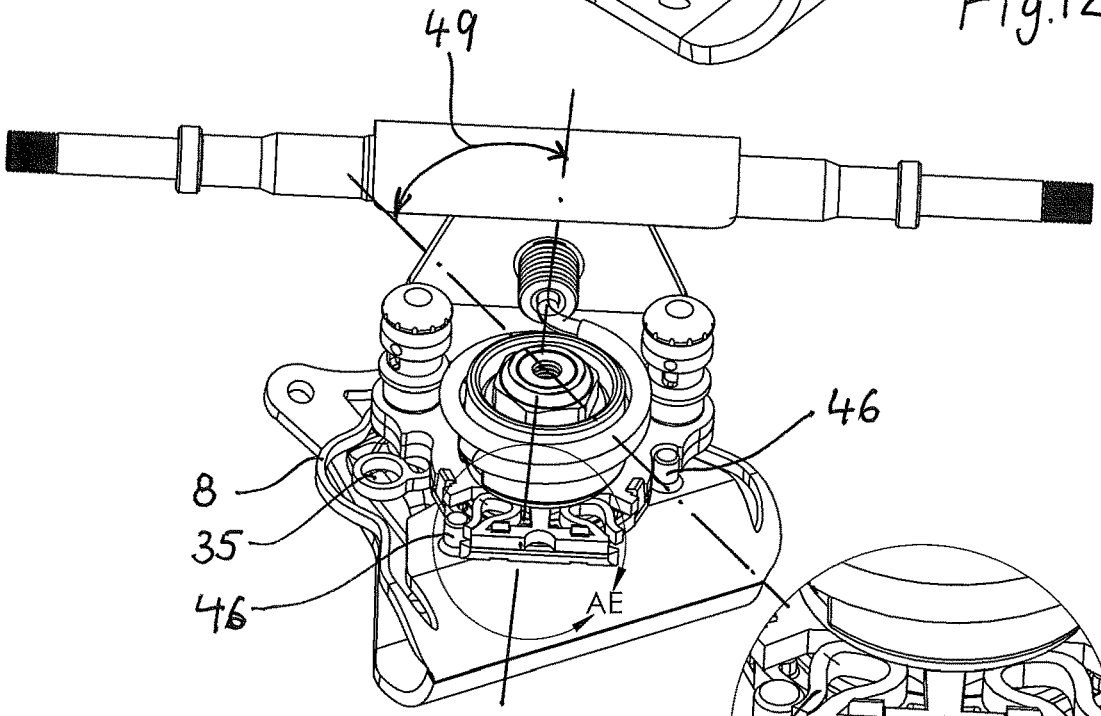
FIG. 13 shows another perspective view of the second embodiment at a steering wheel position and with a housing removed.
Figure 14:
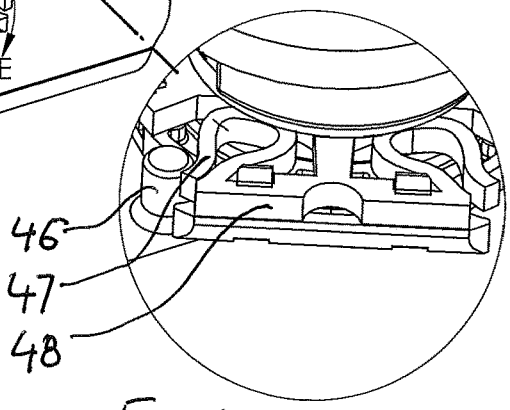
FIG. 14 shows a detail perspective view denoted AE demonstrating a adjustable soft stop according to the second embodiment of the invention.

FIG. 14 shows a further detail, denoted AE in FIG. 13. Shown is a stop here in the form of two bosses 46 against one of which a spring 47 abuts shortly before reaching the final stop position when a certain steering angle close to the maximum steering angle is reached. Further steering angle movement starts deforming the spring 47 until finally the maximum steering wheel angle is demonstrated as shown in FIGS. 13 and 14, where a base member 48 abuts against the free end of the spring 47, sandwiching the spring 47 between the boss 46 and the base member 48. The maximum steering angle is denoted 49 in FIG. 13, and can be for instance 30 degrees. As described in connection with the spring 31 of the first embodiment, the spring 47 of the second embodiment likewise provides both a soft stop as well as a pop back function.

A housing 50 can be provided, accommodating the torsional spring and other elements such as the soft stop created by the combination of boss 46, spring 47 and base member 48, and further accommodating the latching mechanism 36.

Further embodiments are described in the following:

Embodiment

A skateboard truck configured to be mounted to a skateboard deck (6), comprising:

a hanger (3) with a wheel axle (4) configured to hold skateboard truck wheels (5); a suspension system comprising a flex member (7) configured to attach the hanger (3) resiliently to a skateboard deck (6);

a rolling contact bearing (15) connecting the hanger (3) with the flex member (7) such that the rolling contact bearing (15) allows rotation of the hanger (3) with respect to the flex member (7) by a steering angle (17) around a steering axis (16) extending substantially vertically to the wheel axle (4); and a spring mechanism (21) attached to or integrally formed with the flex member (7) biasing the hanger (3) to the neutral position where the steering angle (17) is zero.

Embodiment 2

The skateboard truck according to embodiment 1, wherein the spring mechanism (21) is integrally formed as part of the flex member (7) by voids subdividing the flex member (7) into several parts that can to some extent flex individual from each other.

Embodiment 3

The skateboard truck according to embodiment 2, wherein the flex member (7) comprises a front portion (23), a rear portion (22) and a longitudinal center axis (20) extending between the front and rear portion (22) dividing the skateboard truck into two essentially symmetrical halves; and the spring mechanism comprises two flexible arms (8) that are axially symmetrical with respect with the longitudinal center axis (20) forming the axis of symmetry.

Embodiment 4

The skateboard truck according to embodiment 3, wherein the flex member (7) comprises flexible arms (8) that have an elongated curved shape curving from an outer rear portion (22) of the flex member (7) that is more remote from the longitudinal center axis (20) and closer to the rear portion (22) of the flex member (7) towards an inner front portion (23) that is closer to the longitudinal center axis (20) and to the front portion (23) of the flex member (7).

Embodiment 5

The skateboard truck according to embodiment 4, wherein the flexible arms (8) are loop-shaped curving from the outer rear portion (22) towards a turning point (19) closer to an inner front portion (23) and from there back closer to the outer rear portion (22).

Embodiment 6

The skateboard truck according to embodiment 4 or 5, further comprising a pivot cup (13) bearing (15) attached to the flexible arms (8), said pivot cup (13) configured to hold a protruding element (12) that is attached to or integrally formed with the hanger (3) allowing some rotational and tilting movement degree of freedom of the protruding element (12) with respect to the pivot cup (13) bearing (15).

Embodiment 7

The skateboard truck according to embodiment 4, wherein the pivot cup (13) bearing (15) comprises a pivot cup (13) that accommodates a cup-shaped or hollow cylinder shaped resilient member (14) accommodating a free end of the protruding element (12) such that by deformation of the resilient member (14) the degree of freedom for the rotational and the tilting movement is accomplished.

Embodiment 8

The skateboard truck according to embodiment 5, wherein the pivot cup (13) is located at a front center portion of the flex member (7) and is integrally formed with the two flexible arms (8).

Embodiment 9

The skateboard truck according to one of embodiments 3-8, further comprising a restrictor (27) configured to shorten the flexible length of the two flexible arms (8), thereby increasing the resistance and consequently the biasing force biasing the pivot cup (13) bearing (15) towards a center position with respect to the flex member (7), such center position of the pivot cup (13) bearing (15) establishing the neutral position of the hanger (3) where the steering angle (17) is zero.

Embodiment 10

The skateboard truck according to embodiment 9, wherein the restrictor (27) is movable back and forth in direction of the rear portion (22) of the flex member (7) and vice versa in direction of the front portion (23) of the flex member (7), shortening the flexible length of the flexible arms (8) when moved in the direction of the front portion (23) and therefore increasing the resistance and therefore biasing force, and vice versa extending the flexible length of the flexible arms (8) when moved in the direction of the rear portion (22) and therefore decreasing the resistance and therefore biasing force.

Embodiment 1

The skateboard truck according to one of embodiments 6-10, further comprising at least one stop (31) limiting the maximum moving distance (30) of the pivot cup (13) away from the longitudinal center line (20).

Embodiment 12

The skateboard truck according to embodiment 11, wherein the at least one stop (31) engages the flexible arms (8).

Embodiment 13

The skateboard truck according to one of embodiments 11 or 12, further comprising a spring element (32) that is deformed before the stop (31) is engaged.

Embodiment 14

The skateboard truck according to embodiment 13, wherein the spring element (32) is a spring arm that is deformed towards the stop (31) and urged into contact with the stop (31) when the maximum moving distance (30) of the pivot cup (13) away from the longitudinal center line (20) is reached.

Embodiment 15

The skateboard truck according to embodiment 5, wherein the part of the flexible arms (8) extending from the turning point (19) closer to an inner front portion (23) back closer to the outer rear portion (22) extends in a meander shape.

Embodiment 16

The skateboard truck according to embodiment 5 or 15, wherein a free end of the flexible arms (8) terminates in a latching element configured to be latched to the hanger (3) or any parts attached to the hanger (3), so that when latched the flexible arms (8) are deformed by a rotational movement between the hanger (3) or any parts attached to the hanger (3).

Embodiment 17

The skateboard truck according to one of embodiments 5, 15 or 16, further comprising a torsional spring (44) having a first free end attached to the hanger (3) or any parts attached to the hanger (3) and a second free end connected to the flex member (7) or any parts attached to the flex member (7) so that a rotational movement between the hanger (3) or any parts attached to the hanger (3).

Embodiment 18

The skateboard truck according to embodiment 17, wherein the first free end is movable with respect to the hanger (3) or any parts attached to the hanger (3) for adjusting the spring rate of the torsional spring (44) determining the resistance against relative rotational movement between the hanger (3) or any parts attached to the hanger (3) and the flex member (7) or any parts attached to the flex member (7).

Embodiment 19

The skateboard truck according to embodiment 18, further comprising an adjustment screw configured to move the first free end with respect to the hanger (3) or any parts attached to the hanger (3).

The embodiments are described for demonstration only. It becomes apparent to the skilled artisan that modifications to these embodiments may be made.

What is claimed is:

1. A skateboard truck configured to be mounted to a skateboard deck, comprising:

a hanger with a wheel axle configured to hold skateboard truck wheels;

a suspension system comprising a generally U-shaped flex member having a free forward end, said generally U-shaped flex member being configured to attach the hanger resiliently to the skateboard deck;

a rolling contact bearing connecting the hanger with the flex member such that the rolling contact bearing allows rotation of the hanger with respect to the flex member by a steering angle around a steering axis extending substantially vertically to the wheel axle; and a spring mechanism integrally formed at the free forward end of the generally U-shaped flex member as part thereof, the spring mechanism having voids subdividing the flex member into several parts that can to some extent flex individual from each other, said spring mechanism biasing the hanger to the neutral position where the steering angle is zero.

2. The skateboard truck according to claim 1, wherein the flex member comprises a front portion, a rear portion and a longitudinal center axis extending between the front and rear portion dividing the skateboard truck into two essentially symmetrical halves; and the several parts of the spring mechanism comprises two flexible arms that are axially symmetrical with respect with the longitudinal center axis forming the axis of symmetry.

3. The skateboard truck according to claim 2, wherein the flex member comprises the flexible arms that have an elongated curved shape curving from a first position at an outer rear portion of the flex member that is more remote from the longitudinal center axis and close to the rear portion of the flex member towards a second position at an inner front portion that is close to the longitudinal center axis and to the front portion of the flex member in comparison to the first position.

4. The skateboard truck according to claim 3, wherein the flexible arms are loop-shaped curving from said first position at the outer rear portion towards a turning point and from there to the second position closer to an inner front portion than the second position and from there back to a third position that is closer to the outer rear portion than the second position.

5. The skateboard truck according to claim 4, wherein a pivot cup is located at a front center portion of the flex member and is integrally formed with the two flexible arms.

6. The skateboard truck according to claim 4, wherein the part of the flexible arms extending from the turning point closer to an inner front portion back closer to the outer rear portion extends in a meander shape.

7. The skateboard truck according to claim 4, wherein a free end of the flexible arms terminates in a latching element configured to be latched to the hanger or any parts attached to the hanger so that when latched the flexible arms are deformed by a rotational movement between the hanger or any parts attached to the hanger.

8. The skateboard truck according to claim 4, further comprising a torsional spring having a first free end attached to the hanger or any parts attached to the hanger and a second free end connected to the flex member or any parts attached to the flex member so that a rotational movement between the hanger or any parts attached to the hanger.

9. The skateboard truck according to claim 8, wherein the first free end is movable with respect to the hanger or any parts attached to the hanger for adjusting the spring rate of the torsional spring determining the resistance against relative rotational movement between the hanger or any parts attached to the hanger and the flex member or any parts attached to the flex member.

10. The skateboard truck according to claim 9, further comprising an adjustment screw configured to move the first free end with respect to the hanger or any parts attached to the hanger.

11. The skateboard truck according to claim 3, further comprising a pivot cup bearing attached to the flexible arms, said pivot cup bearing configured to hold a protruding element that is attached to or integrally formed with the hanger allowing some rotational and tilting movement degree of freedom of the protruding element with respect to the pivot cup bearing.

12. The skateboard truck according to claim 11, further comprising at least one stop limiting a maximum moving distance of the pivot cup away from the longitudinal center line.

13. The skateboard truck according to claim 12, wherein the at least one stop engages a spring arm.

14. The skateboard truck according to claim 12, further comprising a spring element that is deformed before the stop is engaged.

15. The skateboard truck according to claim 14, wherein the spring element is a spring arm that is deformed towards the stop and urged into contact with the stop when the maximum moving distance of the pivot cup away from the longitudinal center line is reached.

16. The skateboard truck according to claim 3, wherein the pivot cup bearing comprises a pivot cup that accommodates a cup-shaped or hollow cylinder shaped resilient member accommodating a free end of the protruding element such that a deformation of the resilient member provides degrees of freedom for the rotational and the tilting movement.

17. The skateboard truck according to claim 3, further comprising a restrictor configured to shorten a flexible length of the two flexible arms, thereby increasing the resistance and consequently the biasing force biasing a pivot cup bearing towards a center position with respect to the flex member, such center position of the pivot cup bearing establishing the neutral position of the hanger where the steering angle is zero.

18. The skateboard truck according to claim 17, wherein the restrictor is movable back and forth in a direction of the rear portion of the flex member and vice versa in a direction of the front portion of the flex member, shortening the flexible length of the flexible arms when moved in the direction of the front portion and therefore increasing the resistance and therefore biasing force, and vice versa extending the flexible length of the flexible arms when moved in the direction of the rear portion and therefore decreasing the resistance and therefore biasing force.

* * * * *